United States Patent [19]

Shieh

[11] Patent Number: 4,870,879

[45] Date of Patent: Oct. 3, 1989

[54] QUICK-SET DIAL TYPE TORQUE WRENCH

[76] Inventor: James Shieh, P.O. Box 209, Feng Yuan 420, Taiwan

[21] Appl. No.: 215,263

[22] Filed: Jul. 5, 1988

[51] Int. Cl.[4] ..... B25B 23/142

[52] U.S. Cl. ..... 81/483

[58] Field of Search ..... 81/478, 480, 483

[56] References Cited

U.S. PATENT DOCUMENTS

| | | | |
|---|---|---|---|
| 3,355,970 | 12/1967 | Knudsen et al. | 81/478 |
| 3,577,815 | 5/1971 | Bergquist | 81/483 |
| 3,839,928 | 10/1974 | Bergquist | 81/483 |
| 4,467,678 | 8/1984 | Lindholm | 81/483 |

*Primary Examiner*—Judy Hartman

*Attorney, Agent, or Firm*—Watson, Cole, Grindle & Watson

[57] ABSTRACT

A torque wrench including a shank, a ratchet arm, a torque assembly, a fixed handle, and an axially stable dial. The shank has a flattened portion and a cylindrical portion, both of which are hollow. The ratchet arm pivotably fits in the flattened portion of the shank and the torque assembly fits in the cylindrical portion of the shank. One end of the ratchet arm has a butt with a shank pin fixed on the end of it for contacting with a roller of the torque assembly. The force applied by the roller to the shank pin in proportional to the amount a dial is rotated by a user.

1 Claim, 5 Drawing Sheets

QUICK-SET DIAL TYPE TORQUE WRENCH

BACKGROUND OF THE INVENTION

This invention relates to torque wrenches, and in particular to a torque wrench with an easy set and easy read dial on the rearmost end of the handle.

Due to increasing use of lighter and softer metal, alloy, and even plastic components, torque wrenches are being used more and more to measure the amount of tightening force (or torque) applied to corresponding fasteners. Precision tightening of bolts is necessary on automobiles, power mowers, outboard motors, household appliances, and many other devices. Too much tightening force can stretch the fastener past the point from which it can snap back into original shape after being stretched, making it unfit for further use and possibly warping or twisting the component which is being tightened down. Too little tension reduces the fastener's ability as a clamping device.

In the past, two types of torque wrenches have been available to the general public; i.e., the ratchet type and the lever type. The ratchet (micrometer) type is far more accurate and is used where precise measurements are necessary. However, conventional ratchet type torque wrenches also have their drawbacks. Obviously, the lever type torque wrench is inaccurate and does not limit the amount of torque being applied, but only measures the amount of torque being applied. Conventional ratchet type torques wrenches as shown in FIG. 5 of the present drawings, on the other hand, are accurate but are not as convenient to use, for several reasons:

(1) the pitch of the inner threading of a micrometer type ratchet torque wrench is small, so that it takes about 10 turns of the micrometer handle (D) to turn form the lowest torque setting to the highest torque setting;

(2) the micrometer handle (D) is movable along the shank (C) of the wrench, thereby causing slight variations and inaccuracies in the amount of torque actually applied to the fastener (since torque is basically equal to force times distance); and (3) a locking device (E) is required in order to stabilize the setting on the micrometer handle (D).

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a dial-type torque wrench in which the torque setting is setable in one turn of the dial or less.

Another objective of this invention is to provide a dial type torque wrench which does not require a lock to stabilize the torque setting.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
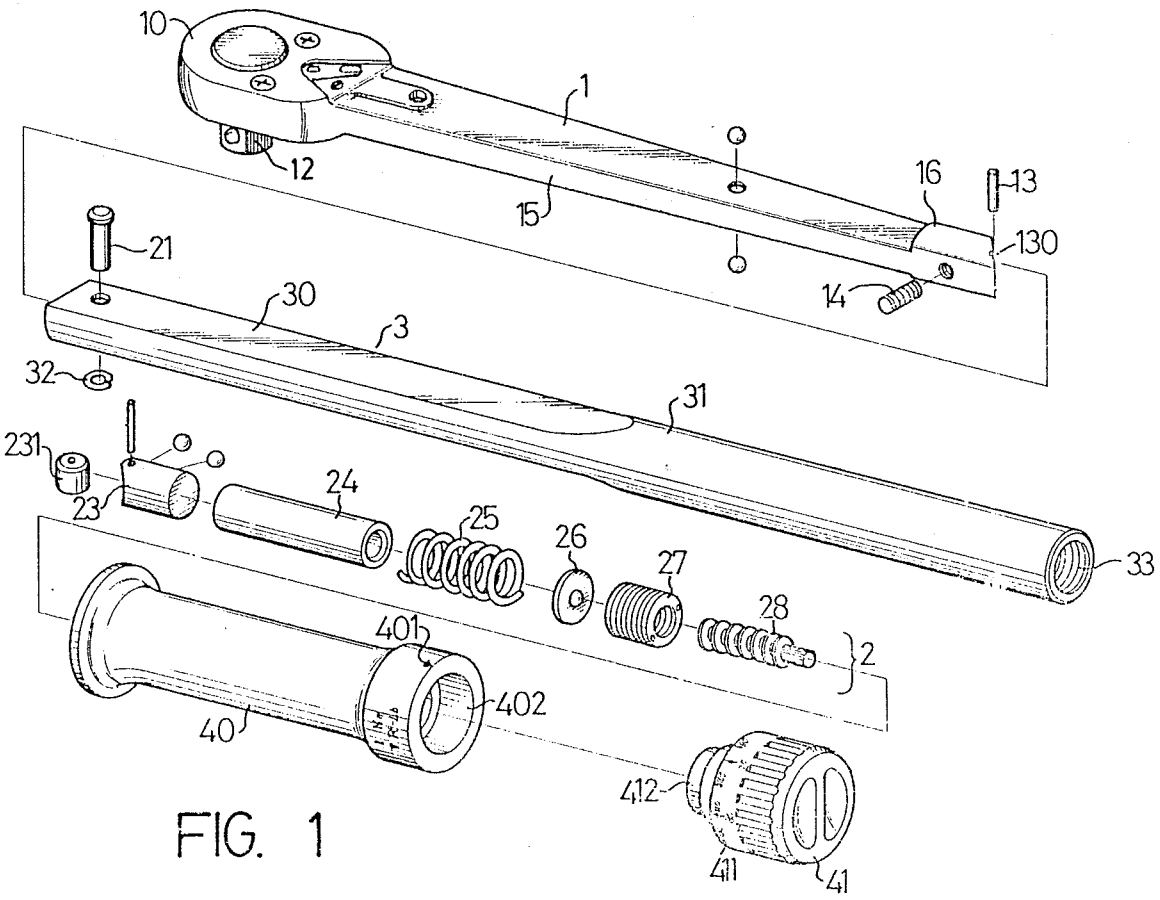
FIG. 1 is an exploded view of a dial type torque wrench in accordance with the present invention.
Figure 4:
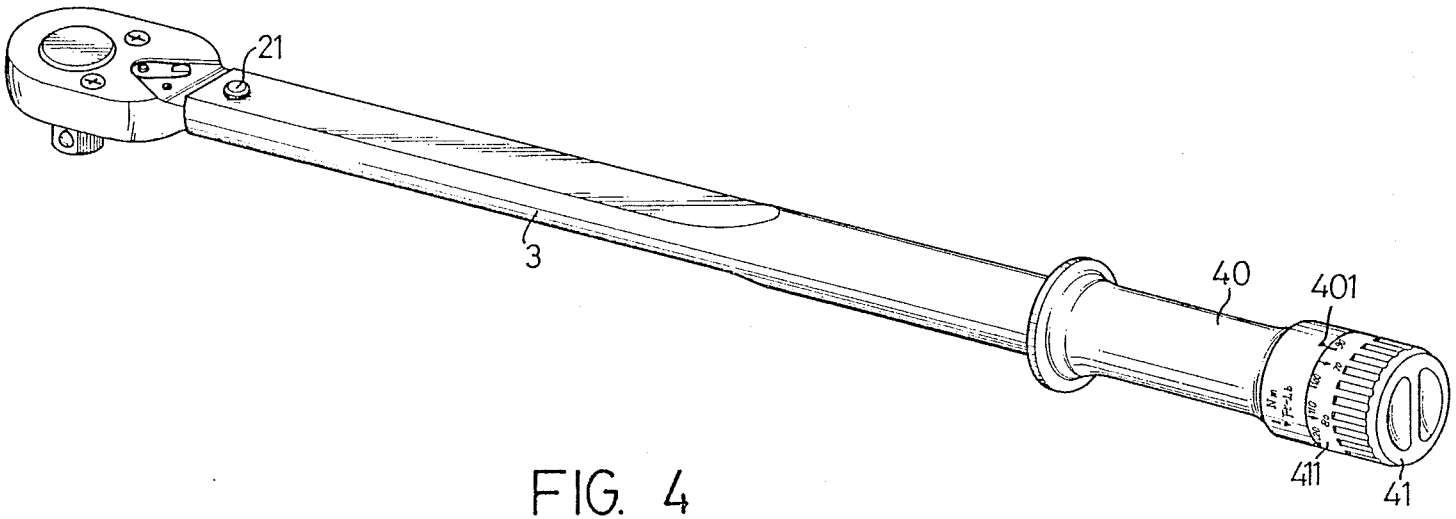
FIG. 4 is a perspective view of the dial type torque wrench of FIG. 1.
Figure 5:
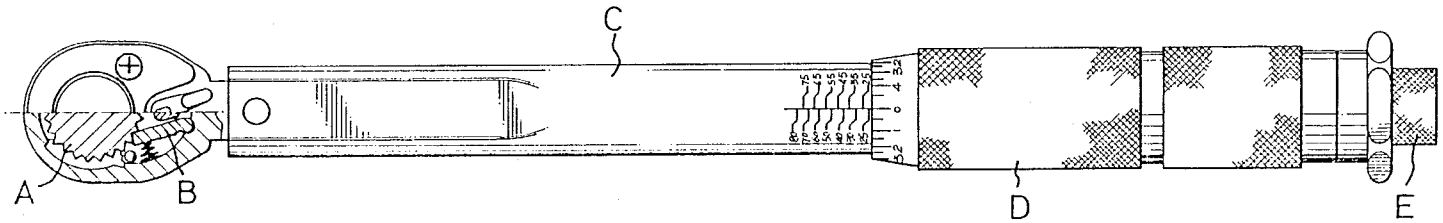
FIG. 5 PRIOR ART
FIG. 5 is a prior art elevational view of a micrometer wratchet type torque wrench with the ratchet head partially cutaway.

Referring to FIG. 1 and 4, it can be seen that the torque wrench of the present invention comprises the combination of a ratchet arm (1), a shank (3) having a cylindrical portion and a flattened portion, a torque assembly (2), a handle (40), and a dial (41).

Figure 3:
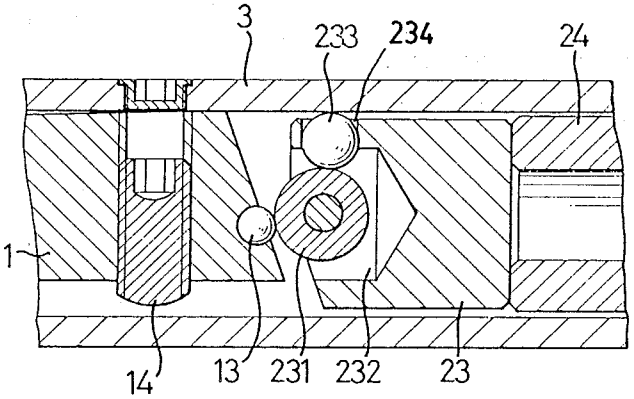
FIG. 3 is an enlarged cutaway view of the roller seat and associated parts of the dial type torque wrench of FIG. 1.

The ratchet arm (1) has a ratchet head (10) including a ratchet and an actuator (12) on one end and a tapered portion (15) on the other end. As the structure of the ratchet head (10), in and of itself, is not new, it will not be further discussed herein. There is a butt (16) on the rear end of the tapered portion (15). A neck pin (21) provides an axis of rotation for the ratchet arm (1) to rotate about, as restricted by the butt (16) of the ratchet arm (1). The butt (16) has a screw (14) which is threadable therein for adjusting the range of motion of the butt (16) within the shank (3), as seen best in FIG. 3. If the screw (14) is protruded out from the butt (16), the butt (16) has a smaller range of motion and vice-versa. A shank pin (13) is fixed in a cavity (130) on a slanted rear end of the butt (16). The function of this shank pin (13) will be described in more detail later in the specification.

The shank (3) is substantially hollow and has a cylindrical portion and a flattened portion. The flattened portion receives the tapered portion (15). The hollow shank (3) also has threads (33) on a rear inner surface thereof.

Figure 2:
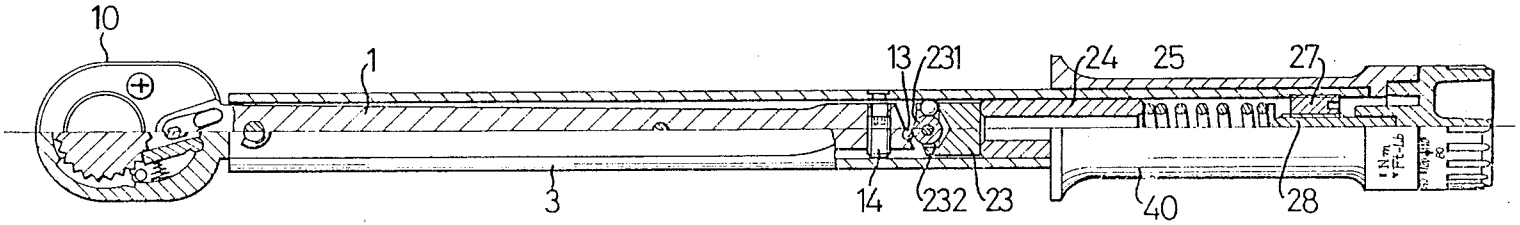
FIG. 2 is a partially cutaway elevational view of the dial type torque wrench of FIG. 1.

From FIGS. 1 and 2, it can be understood that the the rear portion of the shank (3) encompasses a torque assembly (2). This torque assembly (2) comprises a roller seat (23), a sleeve (24), a spring (25), a pad (26), a screw pile (27), and a helical rod (28). The roller seat (23) is adjacent to the sleeve (24) which is adjacent to the spring (25) which, in turn, is adjacent to the pad (26). The pad (26) is adjacent to the screw pile (27). The outer surface of the screw pile (27) is threadedly engaged with and secured by the threads (33) on the rear inner surface of the shank (3). The inner threads of the screw pile (27) threadably receive the helical rod (28) and when the helical rod (28) is rotated, the screw pile (27) is translated axially. The front end of the helical rod (28) contacts the screw pile (27) and moves in accordance with it. The roller seat (23) has a recess (232) at the front end thereof and a roller (231) is rotatably fixed at the front end thereof so as to be substantially encompassed by the recess (232). The roller seat (23) has a plurality of steel balls (233) in a slot (234) at the front end thereof for rotatably stabilizing the roller (231) in conjunction with the shank pin (13) which is fixed in a cavity (130) on a rear end of the tapered portion (15).

The handle (40) fixedly encompasses the rear portion of the shank (3) and is fixed on the outer surface thereof. Because the handle (40) is fixed, it is suitable for setting an accurate reference point for the dial (41). A pointer (401) is provided proximate to the rearmost circumference of the handle (40). The inner portion of a rear end of the handle (40) has a dial seat (402) for receiving and engaging with a stepped protrusion (412) of the dial (41). This stepped protrusion (412) includes an inner and outer cylinder. The inner cylinder of the stepped protrusion (412) engages with a rear portion of the helical rod (28). The dial (41) has a scale (411) thereon for aligning with the pointer (401) on the handle (40).

The dial (41) is rotatable by a user so as to urge the helical rod (28) to rotate and axially urge the screw pile (27) and pad (26). When the user rotates the dial (41), the spring (25) is compressed to a corresponding degree by the screw pile (27) and pad (26). The spring (25) accordingly exerts a force on the sleeve (24), the roller seat (23) and hence the roller (231). This spring force varies according to the amount the spring is compressed. The roller (231) exerts force on the shank pin (13) when the dial (41) is rotated (not more than one turn) by the user so that a certain amount of torsional force (as specified by the alignment of the pointer (401) and the scale (411)) is needed to overcome the turning resistance in the roller (231). Once this turning resistance is overcome, the tapered portion (15) is free to rotate slightly about the neck pin (21), thereby causing a "click" which lets the user know the desired torque has been attained. It should be noted that after the user hears the "click", he should not continue to turn the present torque wrench, as this would obviously overtorque the fastener being tightened.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A torque wrench comprising the combination of:

(a) a ratchet arm (1) having a ratchet head (10) and an actuator (12) on one end thereof and a tapered portion (15) on an opposite end thereof; a butt (16) on a rear end of said tapered portion (15) having a screw (14) being threadable therein for adjusting a range of motion of said butt (16), and a shank pin (13) being fixed in a cavity (130) on a slanted rear end of said butt (16);

(b) a substantially hollow shank (3), said hollow shank (3) having a cylindrical portion and a flattened portion; said flattened portion receiving said tapered portion (15); said hollow shank (3) also having threads (33) on a rear inner surface thereof;

(c) a torque assembly (2) comprising a roller seat (23), a sleeve (24), a spring (25), a pad (26), a screw pile (27), and a helical rod (28) which are encompassed by a rear portion of said shank (3), said roller seat being adjacent to said sleeve (24) which is adjacent to said spring (25) which is adjacent to said pad (26) which is adjacent to said screw pile (27), said screw pile (27) being threadedly engaged with and secured by the threads (33) on the rear inner surface of said shank (3); said screw pile (27) threadably receiving said helical rod (28); a front end of said helical rod (28) contacting said pad (26); said roller seat (23) having a recess (232) at the front end thereof and a roller (231) being rotatably fixed at a front end thereof so as to be substantially encompassed by said recess (232), said roller seat (23) having a plurality of steel balls (233) in a slot (234) at the front end thereof for rotatably stabilizing said roller (231) in conjunction with said shank pin (13), said shank pin being fixed in a cavity (130) on a rear end of said tapered portion (15); and (d) an axially fixed handle (40) which fixedly encompasses a rear portion of said shank (3); said handle (40) having a pointer (401) proximate to a rearmost circumference thereof; an inner portion of said rearmost end of said handle (40) having a dial seat (402) for receiving and engaging a stepped protrusion (412) of a dial (41); an inner cylinder of said stepped protrusion (412) engaging with a rear portion of said helical rod (28); said dial (41) having a scale (411) thereon for aligning with said pointer (401) on said handle (40);

said dial (41) being rotatable to a desired setting by a user to as to urge said helical rod (28) to rotate and axially urge said screw pile (27) and pad (26); said spring (25) being compressible by said screw pile (27) and pad (26), said spring (25) exerting force on said sleeve (24), said roller seat (23) and said roller (231); said roller (231) exerting force on said shank pin (13) when said dial (41) is rotated by said user wherein an amount of torsional force is needed to overcome a turning resistance in said roller (231) and to allow said tapered portion (15) to rotate slightly about said neck pin (21), and whereby said amount of torsional force achieved within one turn of the dial and is indicated by alignment of said pointer with a portion of said scale has been added before.

* * * * *